US011608588B2

(12) United States Patent
Matsubara et al.

(10) Patent No.: US 11,608,588 B2
(45) Date of Patent: Mar. 21, 2023

(54) DAMAGE PROCESSING METHOD AND MANUFACTURING METHOD FOR TEXTILE PRODUCT

(71) Applicant: Fast Retailing Co., Ltd., Yamaguchi (JP)

(72) Inventors: Masaaki Matsubara, Gardena, CA (US); Darwin Dumpit, Gardena, CA (US)

(73) Assignee: Fast Retailing Co., Ltd., Yamaguchi (JP)

( * ) Notice: Subject to any disclaimer, the term of this patent is extended or adjusted under 35 U.S.C. 154(b) by 188 days.

(21) Appl. No.: 16/988,139

(22) Filed: Aug. 7, 2020

(65) Prior Publication Data

US 2022/0042236 A1 Feb. 10, 2022

(51) Int. Cl.

| | |
|---|---|
| ***D06L 4/75*** | (2017.01) |
| ***D06L 4/18*** | (2017.01) |
| ***D06L 4/50*** | (2017.01) |

(52) U.S. Cl.

CPC ..... *D06L 4/75* (2017.01); *D06L 4/18* (2017.01); *D06L 4/50* (2017.01)

(58) Field of Classification Search

CPC ..... D06L 4/75; D06L 4/50; D06L 4/18

See application file for complete search history.

(56) References Cited

U.S. PATENT DOCUMENTS

| | | | | |
|---|---|---|---|---|
| 9,562,318 | B2 | 2/2017 | Youn | |
| 2014/0068871 | A1 | 3/2014 | Youn | |
| 2017/0089004 | A1 | 3/2017 | Youn | |
| 2017/0121902 | A1 | 5/2017 | Youn | |
| 2018/0291553 | A1* | 10/2018 | Schimper | D06P 5/132 |
| 2019/0127906 | A1* | 5/2019 | Matsubara | D06P 5/137 |

FOREIGN PATENT DOCUMENTS

| | | | | |
|---|---|---|---|---|
| JP | 50-126997 | A | 10/1975 | |
| JP | 2019-81993 | A | 5/2019 | |
| WO | 2014/113238 | A2 | 7/2014 | |
| WO | WO 2014/113238 | * | 7/2014 | D06L 3/04 |

OTHER PUBLICATIONS

International Search Report dated Sep. 14, 2021 for International Application No. PCT/JP2021/025696.

* cited by examiner

*Primary Examiner* — Amina S Khan

(74) *Attorney, Agent, or Firm* — Wolf, Greenfield & Sacks, P.C.

(57) ABSTRACT

The present invention relates to provision of a textile product having a naturally faded appearance. A damage processing method for a textile product includes: irradiating a surface of the textile product with a laser beam (S1); washing the textile product irradiated with the laser beam with a phosphoric acid aqueous solution (S5); and exposing the washed textile product to ozone gas (S7).

8 Claims, 4 Drawing Sheets

DAMAGE PROCESSING METHOD AND MANUFACTURING METHOD FOR TEXTILE PRODUCT

BACKGROUND

Technical Field

The present invention relates to a damage processing method and a manufacturing method for a textile product.

Related Art

Generally, a textile product such as denim is decolored in order to form a worn and damaged appearance. For decoloring, in addition to a bleaching method using a chemical, a stone wash method or the like for polishing a surface with sand or stone is used.

An ozone method is known as a decoloring method capable of forming a faded appearance due to damage through a drying process (see, for example, U.S. Pat. No. 9,562,318 B2).

According to the ozone method, water is supplied to a textile product by spraying or the like, and then the textile product is exposed to ozone gas. Aging of an area containing water proceeds due to an oxidizing action of this ozone gas.

Since aging proceeds differently depending on the amount of water supplied, development of a decoloring process capable of forming a naturally faded appearance like a faded appearance due to normal wear is under development.

An object of the present invention is to provide a textile product having a naturally faded appearance.

SUMMARY

One aspect of the present invention is a damage processing method for a textile product, including: irradiating a surface of the textile product with a laser beam (S1); washing the textile product irradiated with the laser beam with a phosphoric acid aqueous solution (S5); and exposing the washed textile product to ozone gas (S7).

Another aspect of the present invention is a manufacturing method for a textile product, including a damage processing step for the textile product. The damage processing step includes: irradiating a surface of the textile product with a laser beam (S1); washing the textile product irradiated with the laser beam with a phosphoric acid aqueous solution (S5); and exposing the washed textile product to ozone gas (S7).

DETAILED DESCRIPTION

Figure 1:
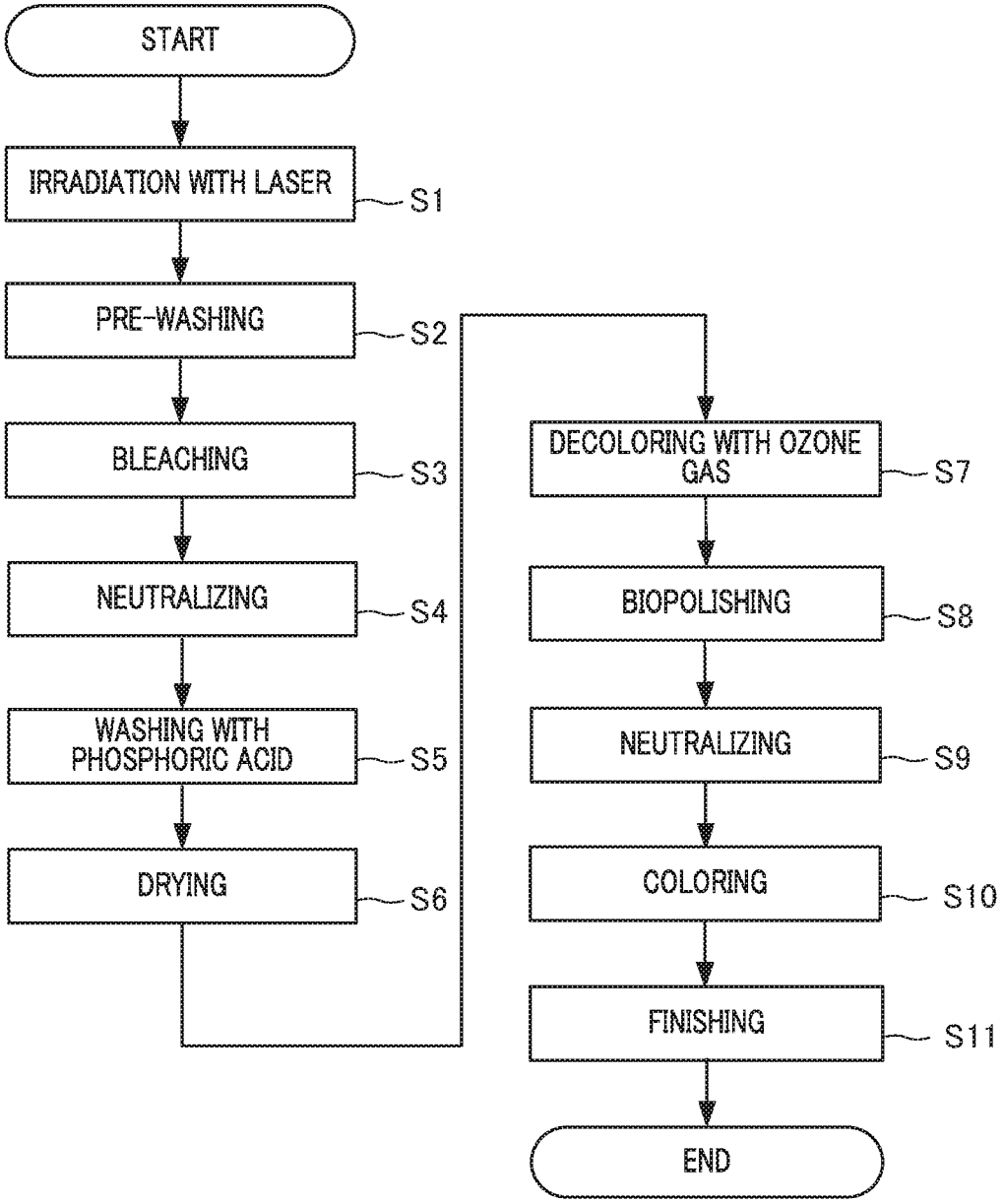
FIG. 1 is a flowchart illustrating a process of a damage processing method of the present embodiment.

Hereinafter, a damage processing method and a manufacturing method for a textile product according to an embodiment of the present invention will be described with reference to the drawings. The following description is one aspect of the present invention, and the present invention is not limited to this configuration.

[Manufacturing Method for Textile Product]

In a manufacturing method for a textile product according to the present embodiment, by decoloring a textile product through a damage processing method described later, a textile product having a naturally faded appearance is manufactured.

In addition to the damage processing, the manufacturing method can include an optional process. For example, when the textile product is a garment, the manufacturing method can also include a process of cutting fabric, a process of sewing fabric to tailor a garment, and the like. These processes may be performed before or after damage processing.

Herein, a textile product is a woven or knitted fabric made of yarn, thread, or the like. Examples of the textile product include fabric, a clothing product obtained by processing fabric, and a rug.

A material of the textile product is not particularly limited, and examples thereof include a natural fiber, a synthetic fiber, and a regenerated fiber.

Examples of the natural fiber include cotton, hemp, flax, and wool. Examples of the synthetic fiber include a polyester resin, an acrylic resin, and a nylon resin. Examples of the regenerated fiber include cupra and rayon.

The textile product can be formed by weaving, knitting, crocheting, knotting, felting, or the like.

Examples of the textile product include denim, but the textile product is not limited thereto. Denim is a cotton textile product with a warp-faced. In denim, threads are twilled, and a weft thread passes under two or more warp threads. This twill weave forms diagonal ribs that distinguish denim from cotton duck.

Common denim is indigo denim or black denim. In indigo denim, a warp thread is dyed with indigo, and a weft thread remains white. As a result of twill weave, one surface of the textile product with a warp thread surface is occupied by blue warp threads, and the other surface is occupied by white weft threads. Therefore, a pair of jeans, which is a denim product, has blue on the outside and white on the inside. In a case of black denim, a warp thread is dyed with a sulfur dye, and the outside of the jeans is black and the inside thereof is white.

A core of an indigo-dyed warp thread remains white, and this provides a fading property characteristic of denim. The color of denim fades over time, but this fading may create a damaged and worn appearance, and may enhance its fashionability.

Usually, a part that is damaged by stress or friction during wearing is faded. Examples of a part of jeans that is likely to be faded include an upper thigh part, an ankle part, and a knee back part. The larger the damage is, the larger the degree of fading is and the brighter the color is due to decoloring.

Denim is tailored into clothing such as jeans, and then subjected to damage processing in order to form a worn appearance. If damage processing can cause fading as in denim aging of which has proceeded by normal wear, more natural damage can be expressed, and a highly fashionable product can be provided.

[Damage Processing Method]

FIG. 1 is a flowchart illustrating a process of a damage processing method for a textile product in the present embodiment.

Hereinafter, an example of a cotton fabric (denim) dyed with indigo will be described as the textile product, but the textile product is not limited thereto.

(Laser Irradiation Process)

In step S1, a surface of an indigo-dyed cotton fabric is irradiated with a laser beam. In this laser irradiation process, a surface area of the cotton fabric is scanned with a laser beam by a laser irradiation device.

Heat is applied to the surface area scanned with the laser beam, and fibers of the fabric are burned. Burning adds damage to express a worn appearance. In addition, desizing can be performed.

The surface area is a three-dimensional area having a thickness. The thickness of the surface area is smaller than the thickness of the textile product, and is, for example, equal to or smaller than a half of the thickness of the textile product.

Energy intensity of the laser beam and irradiation time thereof can be determined such that the surface area of the cotton fabric is scorched and a target damage is added. For example, the irradiation time is one to three minutes.

According to the laser irradiation process, processing can be performed with a device, and therefore a processing speed is faster than shaving processing in which a cotton fabric is manually rubbed with a tool such as sandpaper or a scrubbing brush.

In addition, it is easy to adjust intensity of the laser beam and an irradiation position thereof. Therefore, a specific surface area can be burned to form an image, and the degree of damage can be changed depending on a position to cause natural fading.

(Pre-Washing Process)

After the irradiation with the laser beam, the cotton fabric is washed in step S2. The cotton fabric is put into a washer and stirred in a washing liquid in a bath. For example, a mass ratio between the cotton fabric and the washing liquid is 1:3 to 1:4.

The washer is not particularly limited as long as the washer includes a bath that can perform stirring. Examples of such the washer include a washer including a rotary drum-shaped bath.

The washing liquid contains a cellulase enzyme. The cellulase enzyme can reduce the weight of the cotton fabric, and can impart softness thereto.

The washing liquid may contain a known auxiliary agent such as an anti-back stain agent, if necessary. The anti-back stain agent suppresses dirt due to reattachment of a dye detached from the cotton fabric.

Washing conditions can be appropriately selected depending on the type, color, and the like of the cotton fabric. For example, the cotton fabric is stirred for ten to 50 minutes in the bath containing the washing liquid and set at 40 to 50° C. Subsequently, the washing liquid is drained from the bath, and the cotton fabric is rinsed with water. The rinsing liquid is drained.

(Bleaching Process)

In step S3, the washed cotton fabric is bleached. This bleaching process can be omitted. For auxiliary decoloring, this bleaching process may be performed in addition to decoloring of the cotton fabric by an ozone process described later.

In the bleaching process, a bleaching liquid is put into the bath in the washer. The cotton fabric is soaked in the bleaching liquid, for example for three to 30 minutes, until the cotton fabric is decolored to a desired color. The cotton fabric may be stirred during decoloring.

The bleaching liquid is an aqueous solution of calcium hypochlorite or sodium hypochlorite. Oxidizing actions of these bleaching agents result in a cotton fabric with an indigo natural blue color. For example, a mass ratio between the cotton fabric and the bleaching liquid can be 1:3 to 1:5.

After decoloring, the bleaching liquid is drained from the washer, and the cotton fabric is rinsed with water. For example, a mass ratio between the cotton fabric and the rinsing water is 1:4 to 1:6. Rinsing with water is repeated a plurality of times in order to remove the bleaching liquid.

(Neutralizing Process)

In step S4, the bleached cotton fabric is neutralized.

In the neutralizing process, a neutralizing liquid is put into the bath of the washer. For example, a mass ratio between the cotton fabric and the neutralizing liquid is 1:3 to 1:5. The neutralizing liquid contains sodium metabisulfite and sodium thiosulfate. The neutralizing liquid can also contain an auxiliary agent such as an anti-back stain agent, if necessary.

For example, the cotton fabric is soaked in the neutralizing liquid in the bath set at 45 to 50° C. for five to ten minutes. During this time, the cotton fabric may be stirred. Thereafter, the neutralizing liquid is drained from the bath, and the cotton fabric is rinsed with water. Rinsing is performed several times.

(Phosphoric Acid Washing Process)

In step S5, the neutralized cotton fabric is washed with a phosphoric acid aqueous solution. The pH of the cotton fabric is adjusted to a weak acidity of about 4 to 5 by the phosphoric acid aqueous solution.

By adjusting the pH as described above, it is possible to express more natural damage due to fading when the cotton fabric is exposed to ozone gas in an ozone process described later. In addition, dirt and stains on the cotton fabric can be reduced.

In the phosphoric acid washing process, a phosphoric acid aqueous solution is put into the bath of the washer, and the cotton fabric is soaked in the phosphoric acid aqueous solution. For example, the phosphoric acid aqueous solution has a concentration of 5 to 10 g/L. The cotton fabric may be stirred in the phosphoric acid aqueous solution. Thereafter, the phosphoric acid aqueous solution is drained from the bath.

(Drying Process)

In step S6, the cotton fabric is transferred from the washer to a dryer. The cotton fabric is dried in the dryer until the cotton fabric contains little or no moisture.

(Ozone Process)

In step S7, the cotton fabric is transferred from the dryer to an ozone treatment device and exposed to ozone gas by the ozone treatment device.

The ozone treatment device includes a container that can be sealed while containing the cotton fabric, and an ozone gas generator that supplies ozone gas into the container. Ozone gas is a gas containing $O_3$ molecules and may contain other molecules or impurities contained in the air.

Ozone gas can usually have a concentration of 20 to 80 g/Nm$^3$. The cotton fabric is exposed to ozone gas until the cotton fabric obtains a desired appearance. The longer the time of exposure to ozone gas is, the more easily fading occurs. However, the time of exposure to ozone gas is, for example, 20 to 60 minutes.

The cotton fabric is put into the container of the ozone treatment device together with a plurality of nets. The nets are soaked in water and contain moisture. The content of moisture in the nets can be adjusted before the nets are put into the container. Subsequently, ozone gas is supplied into the container, and the cotton fabric is exposed to ozone gas while being stirred.

In the container, moisture is supplied to the dry cotton fabric from both the nets and ozone gas. In an area where moisture is supplied, an oxidation reaction proceeds and decoloring occurs. In a surface area burned by the laser beam, aging can proceed by decoloring with ozone gas.

A textile product that has been previously washed with a phosphoric acid aqueous solution is naturally faded when being exposed to ozone gas as compared to a case where a textile product has not been washed. Fading is sometimes called fade.

Aging proceeds more easily in an area containing more moisture. However, since moisture gradually moves from the nets to the textile product, there is less variation in aging and more natural fading easily occurs as compared to a case where water is directly supplied to the textile product like spraying.

In addition, since the nets are stirred with the cotton fabric, water is uniformly supplied to the textile product, and natural fading easily occurs.

Although it depends on the desired degree of decoloring, for example, nets containing about 1 to 20% by mass of water with respect to the total mass of the nets can be used in an amount of 10 to 20% by mass with respect to the cotton fabric. In the ozone process, the amount of water in which the nets are soaked is measured such that the content of water in the nets is 1 to 20% by mass. The amount of water supplied to the nets can be adjusted by measuring the amount, and adjusting operation is easy.

Operation to uniformly supply an appropriate amount of water for natural fading is difficult. Manual operation was performed in the past, but use of the nets eliminates need for such manual operation and improves manufacturing efficiency.

Note that each of the nets has coarse meshes unlike cloth, and therefore can avoid an excessive water content, and makes moisture supplying operation easy.

For example, cloth can contain moisture equivalent to 90 to 100% by mass of the cloth. This is an excessive water content for exposure to ozone gas, makes the cloth itself heavy, and makes it difficult to keep a balance in the container. Therefore, uniform water supply is difficult. Therefore, it is necessary to dry cloth to adjust the water content to about 10 to 20% by mass after the cloth is soaked in water.

Meanwhile, the water content of the nets is a moderate water content of about 10 to 15% by mass with respect to the mass of the nets even when the nets are soaked in water, and it is not necessary to adjust the water content by subsequent drying. On the contrary, when the water content is insufficient, it is only required to increase the number of nets used. Therefore, process control is easy, and manufacturing cost can be reduced.

In addition, the net has coarser meshes than cloth, and therefore more easily disperses moisture and can uniformly supply moisture to the surface area of the textile product. Since foreign matters and a dye detached from the textile product are not easily attached to the net, dirt is unlikely to be attached to the textile product through the net.

The net is softer because of having more voids than cloth. Since the shape of the net easily changes according to the shape of the textile product, the frequency of contact with the textile product increases and it is easy to supply moisture.

The net according to the present embodiment is made of resin such as a polyester resin, an acrylic resin, or a nylon resin, and has excellent durability. The net may be a knitted or woven fabric of threads of these resins (synthetic fibers), or may be a molded product of these resins.

In particular, the net is preferably made of a polyester resin. The polyester resin has a lower water content than a natural fiber and other resins, and easily avoids excessive water content.

The shape of the net is not particularly limited, and may be quadrangular, triangular, cylindrical, or the like. The net preferably has a rolled-up shape from a viewpoint of reducing entanglement when the net is stirred.

The size of the net is not limited, but can be about 4 to 10 cm from a viewpoint of suppressing entanglement.

The mesh shape of the net may be quadrangular, rhombic, or the like, and is not limited thereto. A pitch between lines forming the net can be 0.1 to 1.0 cm, and is preferably 0.3 cm or more from a viewpoint of achieving an appropriate water content.

According to the ozone process using the net, an abrasive such as sand or stone is not necessary for causing aging to further proceed and obtaining natural fade, but combined use of the abrasive is not excluded. The abrasive may be put into the container and stirred together with the cotton fabric.

Figure 2:
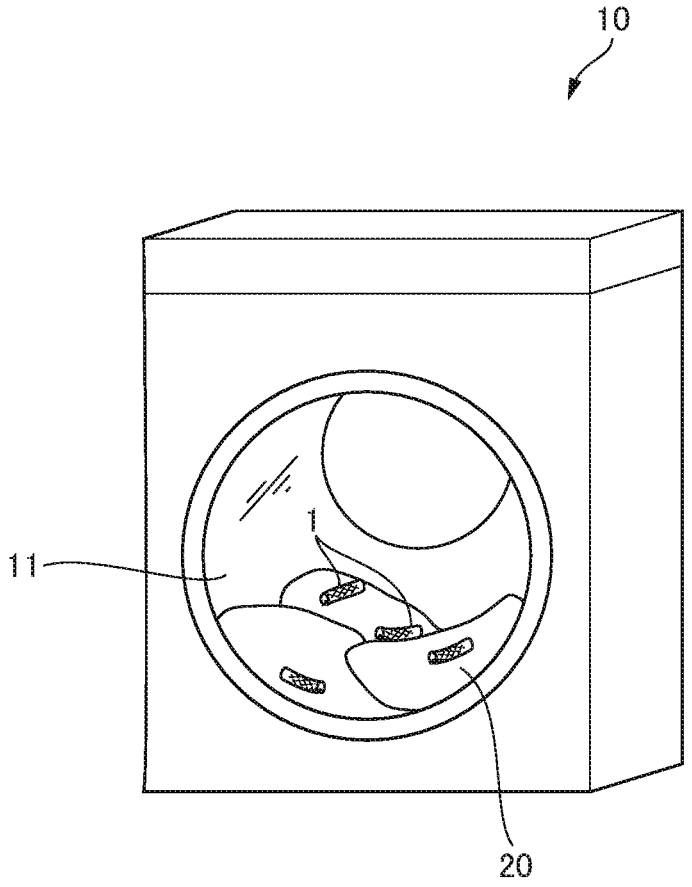
FIG. 2 is a perspective view illustrating an example of a textile product exposed to ozone gas in an ozone treatment device.

FIG. 2 illustrates an example of a cotton fabric exposed to ozone gas by an ozone treatment device.

An ozone treatment device 10 illustrated in FIG. 2 includes a tumbler 11 that is a rotary container.

The ozone treatment device 10 supplies ozone gas into the tumbler 11 and exposes a cotton fabric 20 contained in the tumbler 11 to ozone gas. The ozone treatment device 10 can rotate the tumbler 11 and stir the cotton fabric 20 while the cotton fabric 20 is exposed to ozone gas.

Several nets 1 are also put into the tumbler 11. The nets 1 contain moisture, and the moisture is supplied from the nets 1 to the cotton fabric 20 by stirring the nets 1 together with the cotton fabric 20.

Figure 3:
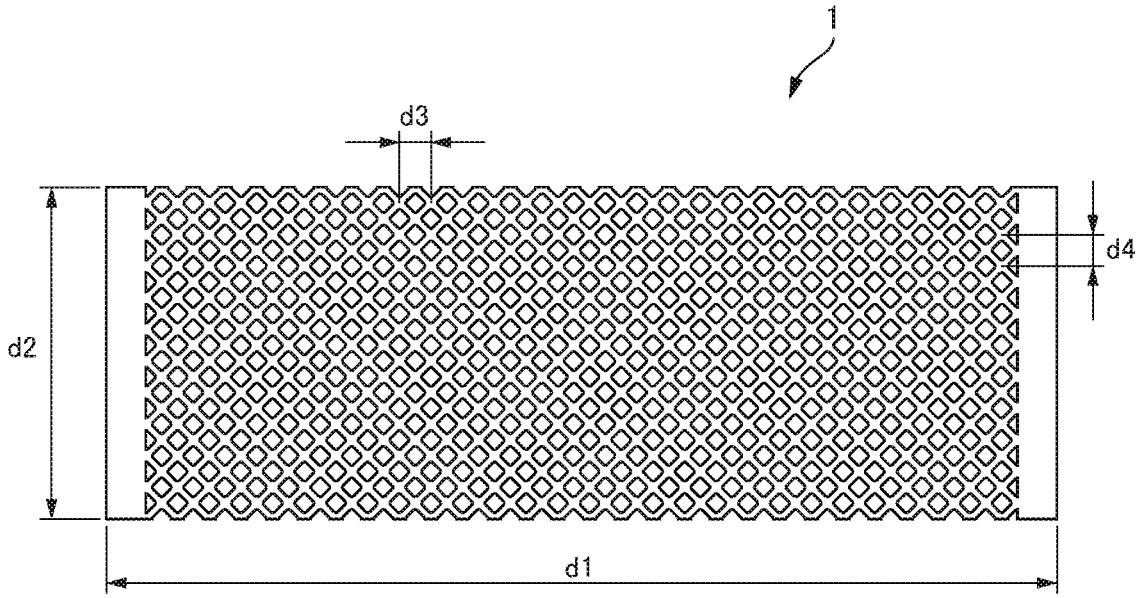
FIG. 3 is a plan view illustrating an example of a net.
Figure 4:
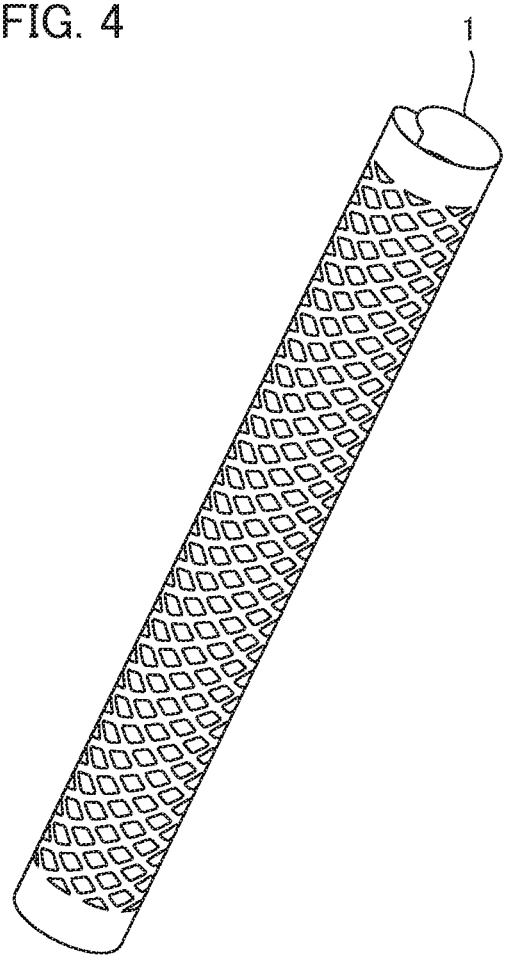
FIG. 4 is a perspective view illustrating a rolled-up shape of the net.

FIG. 3 illustrates an example of the net 1. FIG. 4 illustrates a rolled-up shape of the net 1 of FIG. 3.

The net 1 is knitted with a thread made of a polyester resin.

The net 1 has a quadrangular shape on a plane. A length d1 of one side (long side) of the quadrangle is preferably twice or more a length d2 of the other side (short side). Such a net 1 is easily curled and easily forms a rolled-up shape.

The net 1 can be curled in various directions such as a long side direction, a short side direction, and an oblique direction. Since the size of the net 1 is reduced by curling, entanglement between the net 1 and the textile product or entanglement between the nets 1 can be reduced.

For example, the length d1 of the long side of the net 1 is 8.7 cm and the length d2 of the short side thereof is 3 cm. A pitch d3 between threads of the net 1 in a long side direction and a pitch d4 between threads of the net 1 in a short side direction are both 0.3 cm.

Note that an upper limit of the length d1 is not particularly limited, but can be usually 5 to 10 times or less the length d2. The lengths d1 and d2 only need to be appropriately determined such that the size does not easily cause entanglement during use (when the net is rolled up), for example, the total length is about 4 to 10 cm.

Similarly, the mesh of the net 1 preferably has a rhombic shape from a viewpoint of facilitating formation of a curl. As described above, entanglement can be reduced by rolling up the net 1.

(Biopolishing Process)

In step S8, the cotton fabric is again transferred into the bath of the washer and washed with a washing liquid containing a cellulase enzyme.

Fibers on a surface of the cotton fabric may be exfoliated and fluffed through the processes up to this time, but in the biopolishing process, such fibers are enzymatically removed to suppress fluffing.

For example, the cotton fabric is stirred for ten to fifteen minutes in the bath containing the washing liquid and set at 30 to 40° C. A mass ratio between the cotton fabric and the washing liquid can be 1:3. Thereafter, the cotton fabric is rinsed with water.

(Neutralizing Process)

In step S9, the cotton fabric is neutralized in order to remove ozone odor of the cotton fabric exposed to ozone gas and to reduce yellowing.

In the neutralizing process, first, a sodium thiosulfate solution and an anti-back stain agent are put into the bath in the washer. For example, the cotton fabric is stirred for two minutes in the bath set at 45° C. A mass ratio between the cotton fabric and the sodium thiosulfate solution can be 1:3.

Subsequently, a chemical, a detergent and hydrogen peroxide are sequentially introduced into the bath, and are stirred for 8 to 13 minutes. Thereafter, the sodium thiosulfate solution is drained from the bath. Thereafter, rinsing with water is performed several times.

(Coloring Process)

In step S10, the cotton fabric is colored. This coloring process may be performed, if necessary. A direct dye can be used in the coloring process. The amount of the dye used can be determined depending on a desired color or density.

(Finishing Process)

In step S11, a finishing process of the cotton fabric is performed.

For example, the finishing process includes a process of increasing softness of the cotton fabric using a softening agent containing silicone or the like, a process of increasing friction fastness of the cotton fabric using a fixing agent, a process of adjusting the pH of the cotton fabric using citric acid or the like, and the like.

As described above, according to the present embodiment, the surface area of the textile product is burned by a laser beam, and then the textile product is exposed to ozone gas. As a result, aging of the textile product can proceed, and the textile product can be faded.

The textile product is washed with a phosphoric acid aqueous solution and adjusted so as to have a weakly acidic pH before the textile product is exposed to ozone gas. Therefore, it is possible to provide a naturally faded textile product as in normal wear when the textile product is exposed to ozone gas. In addition, dirt, stains, and the like on the cotton fabric can be reduced.

The preferred embodiment of the present invention has been described above, but the present invention is not limited to the embodiment, and various modifications and changes can be made within the scope of the gist thereof.

REFERENCE SIGNS LIST

1 net
10 ozone treatment device
20 cotton fabric

What is claimed is:

1. A damage processing method for a textile product, comprising:
- irradiating a surface of the textile product with a laser beam (S1);
- washing the textile product irradiated with the laser beam with a phosphoric acid aqueous solution (S5); and
- exposing the washed textile product to ozone gas (S7) and stirring the textile product together with a moisture-containing net (1) while the textile product is exposed to the ozone gas.

2. The damage processing method according to claim 1, wherein
- the exposing to the ozone gas (S7) includes
- adjusting a content of moisture in the net (1).

3. The damage processing method according to claim 2, wherein
- the net (1) has a rolled-up shape.

4. The damage processing method according to claim 2, wherein
- the net (1) has a rhombic mesh.

5. The damage processing method according to claim 2, wherein
- the net (1) is quadrangular, and
- a length (d1) of one side of the quadrangle is twice or more a length (d2) of the other side.

6. The damage processing method according to claim 2, wherein
- the net (1) is made of resin.

7. The damage processing method according to claim 1, further comprising:
- reducing a weight of the textile product (S2);
- bleaching the textile product (S3); and
- drying the textile product before the textile product is exposed to the ozone gas (S6).

8. A manufacturing method for a textile product, comprising
- a damage processing step for the textile product, wherein
- the damage processing step includes:
- irradiating a surface of the textile product with a laser beam (S1);
- washing the textile product irradiated with the laser beam with a phosphoric acid aqueous solution (S5); and
- exposing the washed textile product to ozone gas (S7) and stirring the textile product together with a moisture-containing net (1) while the textile product is exposed to the ozone gas; and
- a finishing process step.

* * * * *